US006048429A

United States Patent [19]

Cummings et al.

[11] Patent Number: 6,048,429

[45] Date of Patent: Apr. 11, 2000

[54] PRODUCTION OF DOUBLE WALL CORRUGATED WEB

[75] Inventors: James A. Cummings; Carl R. Marschke, both of Phillips, Wis.

[73] Assignee: Marquip, Inc., Phillips, Wis.

[21] Appl. No.: 09/132,539

[22] Filed: Aug. 11, 1998

[51] Int. Cl.[7] ..... B31F 1/28

[52] U.S. Cl. ..... 156/205; 156/210; 156/472

[58] Field of Search ..... 156/470, 471, 156/472, 473, 205, 210, 207; 428/184, 186, 182; 264/286, 287; 427/211; 493/463

[56] References Cited

U.S. PATENT DOCUMENTS

| | | | |
|---|---|---|---|
| 1,184,748 | 5/1916 | Hicks . | |
| 1,709,934 | 4/1929 | Cumfer . | |
| 1,902,312 | 3/1933 | Rous . | |
| 4,774,107 | 9/1988 | Von Kwiatkowski et al. | 427/211 |
| 4,886,563 | 12/1989 | Bennett et al. . | |
| 4,935,082 | 6/1990 | Bennett et al. . | |
| 5,348,610 | 9/1994 | McKinlay et al. . | |
| 5,674,349 | 10/1997 | McKinlay et al. . | |
| 5,693,167 | 12/1997 | Cahill et al. . | |
| 5,891,302 | 4/1999 | Marschke | 156/470 |

FOREIGN PATENT DOCUMENTS

| | | |
|---|---|---|
| 1102560 | 10/1955 | France . |

*Primary Examiner*—Michael W. Ball
*Assistant Examiner*—Barbara Musser
*Attorney, Agent, or Firm*—Andrus, Sceales, Starke & Sawall

[57] ABSTRACT

A synchronized flute double wall corrugated paperboard web is produced in a corrugating apparatus utilizing cooperatively operated single facers to provide an intermediate single face web with corrugated media on both faces, and then combining outer liners to both corrugated media immediately prior to on entry into the double backer utilizing a glue applicator that precludes glue line disturbance. The system may also be operated to produce conventional double wall board or single wall board utilizing either of the single facers. A synchronized flute double wall board provides enhanced strength and may be run on this corrugator at the same speed as single wall board.

14 Claims, 3 Drawing Sheets

PRODUCTION OF DOUBLE WALL CORRUGATED WEB

BACKGROUND OF THE INVENTION

The present invention pertains to the production of composite corrugated webs, such as paperboard, and more particularly to the production of double wall corrugated paperboard web in which the flutes of the corrugated medium webs are synchronized and aligned flute-to-flute.

Single wall and double wall corrugated paperboard webs have traditionally been made in a corrugator utilizing, respectively, a basic two stage and three stage process. For single wall board, a single face web, comprising a corrugated medium web and a liner web, are formed in a single facer. In the second stage, the single face web is transferred to a double backer where a second liner web is glued to the exposed corrugated medium web flute tips of the single face web and is passed through a heating section to cure the adhesive and complete the single wall web. Production of conventional double wall corrugated board typically utilizes a second intermediate single facer to produce another single face web in a second stage of the production process. In the third stage, the second single face web is adhesively attached by its liner web to the exposed glued flute tips of the first single face web and, simultaneously, the final (usually lower) liner web is brought into contact with the exposed glued flute tips of the second single face web, and the assembled webs are transported through the heating section of a double backer to provide a final adhesive cure and form the double wall corrugated web.

Typically, in the manufacture of double wall corrugated board, the two single face webs are joined without regard to alignment or synchronization between the flutes in the corrugated media of the two webs. Indeed, often the two single facers produce corrugated webs in which the pitch length of the flutes is different and, therefore, no alignment or synchronization is possible.

However, another type of double wall corrugated web is produced in which the intermediate liner web is eliminated, the flutes on the two facing single face webs are aligned, synchronized, and glued together flute tip-to-flute tip. The device for producing this type of double wall corrugated board is shown, for example, in U.S. Pat. No. 4,935,082. It has been suggested that such double wall corrugated board may be produced with a strength equivalent to conventional double wall board with an additional saving in paper by eliminating the intermediate liner web. However, the production of this modified double wall corrugated web is very slow by today's corrugating standards and cannot be produced at speeds greater than about 425 feet per minute (fpm).

SUMMARY OF THE INVENTION

In accordance with the present invention, there is provided a high speed corrugator for the production of double wall corrugated paperboard web in which flute-to-flute synchronization between the two single face webs is provided, but without eliminating the intermediate liner web. The corrugating system may also be utilized to produce single wall web utilizing either of the two component single facers, or conventional double wall web.

The corrugating apparatus of the present invention comprises a single facer which produces a first corrugated medium web and adhesively joins it to one face of an intermediate liner web to provide a first single face web. A second single facer produces a second corrugated medium web and adhesively joins it to the other face of the intermediate liner web (from the first single facer) to provide an intermediate single face web in which the first and second corrugated medium webs are joined to the respective opposite faces of the intermediate liner web. The intermediate single face web (having exposed flute tips on both sides) is directed into a double backer where first and second outer liner webs are adhesively joined to the respective first and second medium webs of the intermediate single face web to provide a corrugated double wall web.

Preferably, the second single facer includes a synchronization device which aligns the flute tips of the first and second corrugated medium webs, such that said flute tips, when joined to the opposite faces of the intermediate liner web, are directly aligned. In a presently preferred embodiment, the first and second single facers include fluted corrugating rolls which provide flutes of identical pitch length in each of the corrugated medium webs. The synchronization device comprises a fluted timing roll which carries the initial single face web into joining contact with the second corrugated medium web on the fluted corrugating roll of the second single facer, with said fluted timing roll controlled to provide flute-to-flute register with the fluted corrugating roll of the second single facer. Alternately, the corrugating roll of the first single facer may be provided with a flute pitch length slightly shorter than the flute pitch length of the second single facer corrugating roll. In this embodiment, the synchronization device comprises a tensioning roll which carries the initial single face web into joining contact with the second corrugated medium web on the fluted corrugating roll of the second single facer, said tensioning roll also applying a tension to the intermediate liner web sufficient to stretch the web by an amount equal to the difference in flute pitch lengths between the first and the second corrugating rolls. The pitch length differential may be up to about 0.4%.

The double backer preferably includes upper and lower heating devices which provide direct contact heating to the first and second outer liner webs. In the preferred embodiment, each of the first and second single facers includes a corrugating nip which is defined in part by a large diameter heated fluted corrugating roll around a substantial portion of the circumference of which the respective adhesively joined medium and liner webs are wrapped to provide a selected level of adhesive bond strength.

A unique glue applicator includes two glue rolls which are positioned to apply glue to the exposed flute tips of the respective first and second corrugated medium webs immediately prior to web entry into the double backer such that the freshly glued exposed flute tips are contacted only by the respective first and second outer liner webs, thereby avoiding disturbance of the glue lines prior to web joinder. In one embodiment of the glue applicator, the glue rolls have their axes of rotation substantially aligned in a common vertical plane to apply glue to the exposed flute tips of the respective first and second medium webs simultaneously. In another embodiment, the glue rolls are spaced in the direction of web movement such that glue is applied to the exposed flute tips of the respective first and second medium webs sequentially. In addition, the glue rolls of this embodiment are positioned to cause the intermediate single face web to be wrapped on the glue rolls in a serpentine path to provide web tension sufficient to transfer glue to the exposed flute tips.

In accordance with the method of the present invention, a double wall corrugated web is made utilizing the steps of: forming a first corrugated medium web and adhesively joining said first medium web to one face of an intermediate liner web in a first single facer to provide an initial single face web; forming a second corrugated medium web and adhesively joining said second medium web to the other face of said intermediate liner web in a second single facer to provide an intermediate single face web having said first and second corrugated medium webs joined to the respective opposite faces of said liner web; and, adhesively joining first and second outer liner webs to the respective first and second medium webs of the intermediate single face web in a double backer to provide the double wall corrugated web. The method preferably includes the step of synchronizing the flute tips of the first and second corrugated medium webs such that said flute tips, when joined to the opposite faces of the intermediate liner web, are directly aligned.

DETAILED DESCRIPTION OF THE PREFERRED EMBODIMENTS

Figure 1:
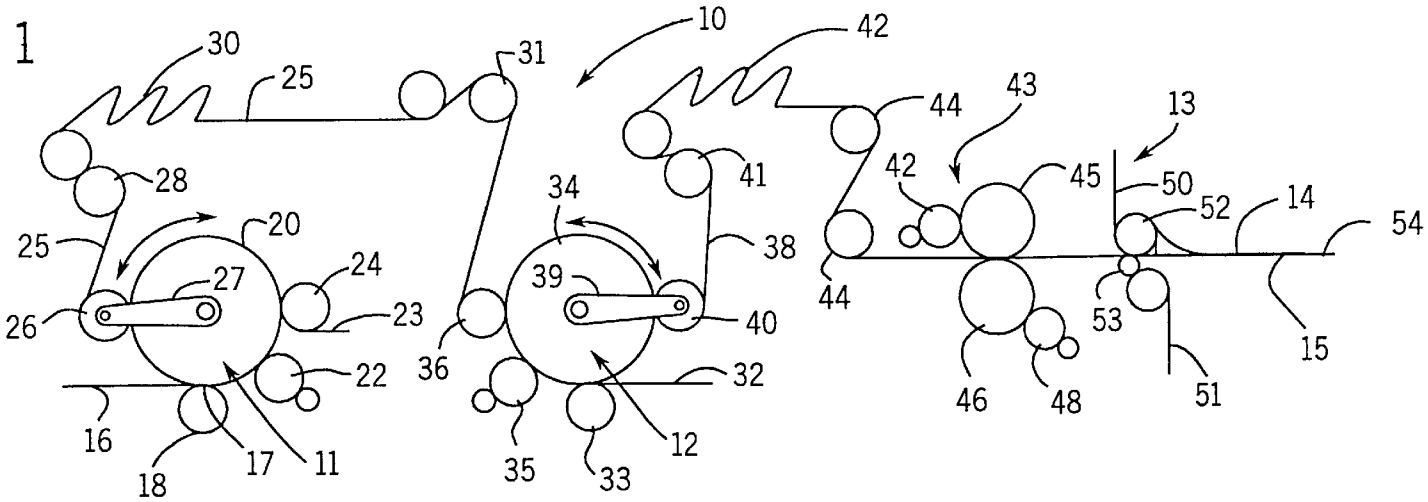
FIG. 1 is a schematic side elevation view of a corrugating apparatus incorporating the subject invention.

A corrugating apparatus 10 of the present invention is shown schematically in FIG. 1. The corrugator 10 is uniquely adaptable to produce timed flute tip double wall corrugated web in which the flute tips of the two corrugated media are directly aligned or synchronized, conventional double wall corrugated web, or at least two different flute versions of single wall corrugated web. The corrugator 10 includes an upstream first single facer 11, an intermediate second single facer 12, a glue machine 43 and a downstream double backer 13. Each of the single facers 11 and 12 are preferably constructed in accordance with the teaching of U.S. patent application Ser. No. 09/044,516 of C. R. Marschke. However, as will be described hereinafter, the first single facer 11 may be of a conventional prior art construction. The glue machine includes two back-to-back glue applicator rolls that also act as rider rolls for each other in simultaneously applying glue to the top and bottom sides of the single face web. The double backer 13 includes an upper heating unit 14 and a lower heating unit 15. The upper heating unit 14 may be constructed in accordance with the teaching of U.S. patent application Ser. No. 08/697,768 of C. R. Marschke or U.S. patent application Ser. No. 09/056,537 of C. R. Marschke et al. The lower heating unit 15 may comprise a conventional prior art double backer hot plate system, but preferably comprises a lightweight, fast response hot plate system of the type shown in U.S. Pat. No. 5,766,409. The foregoing patent applications and patent are incorporated herein by reference.

Figure 4:
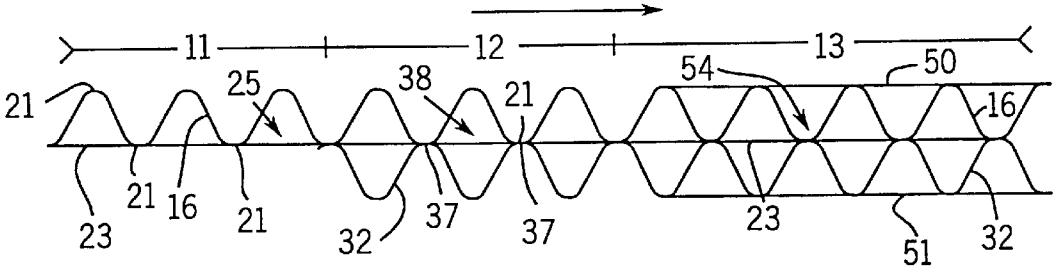
FIG. 4 is an enlarged side elevation view showing the sequence of formation of double wall corrugated web produced in the corrugating apparatus of FIG. 1.

The basic construction and operation of the corrugator 10 will now be described with reference to FIG. 1 and operating in a mode to produce double wall corrugated web with synchronized and directly aligned flute tips. A schematic view of such a double wall web showing the production sequence, is shown in FIG. 4 to which reference will be made from time to time. In the first single facer 11 a first corrugated medium web 16 is formed in a nip 17 between a small diameter lower fluted corrugating roll 18 and a much larger diameter upper fluted bonding roll 20. The bonding roll 20 is also internally heated. Glue is applied to the exposed flute tips 21 of the first corrugated medium web 16 carried on the bonding roll 20 by a glue applicator roll 22. A first intermediate liner web 23 is brought into contact with the glued flute tips of the medium web 16 around a contact generator roll 24 that does not make contact with the bonding roll 20. The resultant first single face web 25 is wrapped on the bonding roll 20 where an initial adhesive green bond is formed sufficient to maintain integrity of the single face web 25 for movement downstream in the corrugator. In accordance with the teaching of the co-pending patent applications identified above, the circumferential portion of the bonding roll 20 around which the first single face web 25 is wrapped may be varied to suit conditions by adjusting the rotational position of a wrap roll 26 attached to a wrap arm 27. Web tension in the liner web 23 is created by the generator roll 24 and a high coefficient of friction vacuum pull roll 28. The resulting first single face web 25 has the flute tips of the corrugated medium web 16 pointing upward as it is conveyed downstream in the corrugator 10. The first single face web 25 may initially be directed into a first bridge storage 30 in a manner well known in the art.

As the first single face web 25 leaves the bridge storage 30, it is pretensioned by passage around a high coefficient of friction capston roll 31, from which the web is introduced into the second single facer 12. In the second single facer, a second medium web 32 is corrugated between a lower corrugating roll 33 and a large diameter upper bonding roll 34 in the same manner as in the first single facer 11. The flute pitch lengths in the first and second corrugated medium webs are the same. Glue is applied to the flute tips of the second corrugated medium web 32 by glue applicator roll 35. The first single face web 25 passes around a fluted generator/timing roll 36, the flute tips of which match the flute pattern of the single face web 25. The generator/timing roll 36 preferably includes an internal vacuum source communicating with the fluted surface to draw the single face web 25 into intimate contact. The generator roll 36 creates or maintains tension in the web 25 and directs the intermediate liner web 23 into contact with the glued flute tips 37 of the second corrugated medium web 32 traveling on the upper bonding roll 34. The fluted generator roll 36 is connected by an adjustable gear system (not shown) to the upper bonding roll 34 and is adjusted to be driven to bring the flute tips 21 of the first corrugated medium web 16 into synchronization and direct alignment with the flute tips 37 of the second corrugated medium web 32 on the bonding roll 34 (the corrugated medium webs 16 and 32 being separated by the intermediate liner web 23, as may be seen in FIG. 4). The resultant intermediate single face web 38, comprising the first and second corrugated medium webs 16 and 32 adhesively affixed by their respective inner flute tips to opposite faces of the intermediate liner web 23, is wrapped around a selectively variable circumferential portion of the heated upper bonding roll 34 by a fluted idler wrap roll 40 on wrap arm 39, in a manner similar to operation of the wrap roll 26 of the first single facer. From the fluted wrap roll 40, the intermediate single face web 38 continues around a downstream fluted vacuum pull roll 41, driven to create tension in the single face web 38 upstream to the generator/timing roll 36. This tension is important to maintain intimate contact between the single face web 38 and the fluted surface of the heated bonding roll 34.

The intermediate single face web 38 may be transferred to a second bridge storage 42 or may continue directly to a downstream glue applicator 43 after travel around a pair of spaced idler rolls 44 which may be fluted or smooth. The downstream idler roll 44 orients the single face web 38 to move horizontally into the glue applicator 43. Glue is metered onto the surface of upper and lower glue applicator rolls 45 and 46, respectively, by doctor rolls 47 and 48. Thus, glue is simultaneously applied to the exposed flute tips 21 and 37 of the corrugated media 16 and 32, respectively, of the intermediate single face web 38. Immediately downstream from the glue applicator 43, an upper first outer liner 50 and a lower second outer liner 51 are brought into contact with the exposed glued flute tips of intermediate single face web 38 by upper and lower delivery rolls 52 and 53, respectively, and from which the freshly assembled double wall corrugated web 54 is directed into the double backer 13. The double backer heats the web 54 from the top using the upper heating unit 14 and from the bottom using the lower heating unit 15. The respective upper and lower heating units 14 and 15 are preferably of a type described in the above identified co-pending U.S. patent applications. The ability to heat the web from both above and below in the double backer 13 permits curing of the adhesive at high speeds, far in excess of the speeds at which prior art synchronized flute double wall board could be produced and at speeds substantially in excess of production speeds for conventional double wall board.

In a slightly modified construction and operation of the corrugator 10, the first single facer 11 is provided with modified corrugating rolls 18 and 20 formed to provide a flute pitch length just slightly shorter (e.g. 0.3%) than the flute pitch length provided by the second single facer 12. A pitch length variation up to about 0.4% may be used. For this purpose, a conventional prior art single facer could be used in lieu of the first single facer 11, although the well formed flutes provided by single facer 11 are preferable. The first single face web 25 formed with the slightly shortened pitch length flutes is carried downstream to the second single facer 12 as previously described. The generator timing roll 36 and the fluted vacuum pull roll 41, between which tension on the intermediate single facer web 38 is created, are formed with flute patterns identical to that of the second single facer bonding roll 34, i.e. normal pitch length. Sufficient tension is applied to the joined intermediate single face web on the upper bonding roll 34 to stretch the intermediate liner web 23 and increase the pitch length in the flutes of the first corrugated medium web 16 to match the pitch length of the second corrugated medium web 32 on the upper bonding roll 34. Otherwise, the generator/timing roll 36 is geared to the bonding roll and adjusted to provide precise alignment between the flute tips 21 and 37 of the respective corrugated media 16 and 32 as previously described. The increased web tension required to restore full pitch length to the intermediate liner web 23 provides a supplemental hoop stress loading against the bonding roll 34 to provide even more intimate contact and enhanced curing of the adhesive, without imposing any detrimental crushing load on the flute tips of either corrugated medium.

Figure 6:
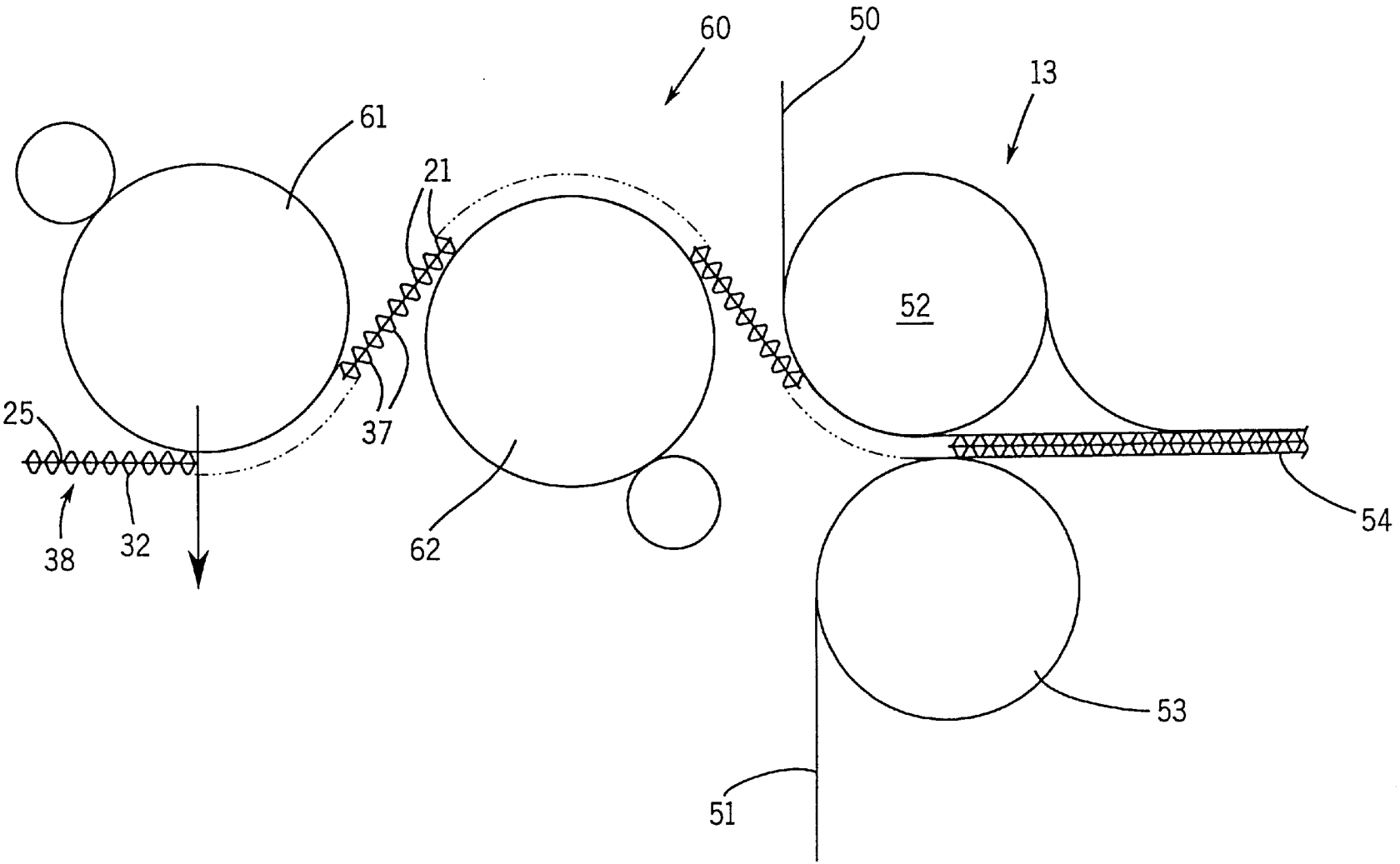
FIG. 6 is an enlarged schematic side elevation view of an alternate embodiment of the glue applicator for the double backer.

An advantage of the glue applicator 43 is that glue may be applied to the exposed flute tips of the corrugated medium webs 16 and 32 on both sides of the intermediate single face web 38 in a manner precluding any subsequent disturbance of the freshly applied glue lines prior to entry of the glued single face web into the double backer 13. Further, the vertical alignment and superposition of the upper and lower glue applicator rolls 45 and 46 allows the glue to be applied simultaneously such that each applicator roll also acts as the back-up rider roll for the other applicator roll. In FIG. 6, there is shown an alternate embodiment of a glue applicator 60 in which the first applicator roll 61 is positioned upstream of the second applicator roll 62 with respect to the direction of movement of the intermediate single face web 38. Further, the first and second applicator rolls 61 and 62 are positioned so that the web 38 is wrapped in a serpentine path on the rolls. With this glue applicator embodiment, the freshly glued exposed flute tips are not subject to any disturbing contact prior to entry into the double backer 14, as with the previously described embodiment. In addition, the serpentine wrap of the web on the applicator rolls provides sufficient web tension to assure proper glue transfer from the roll to the exposed flute tips. Tension may be varied by adjusting the relative positions of the rolls 61 and 62.

Figure 2:
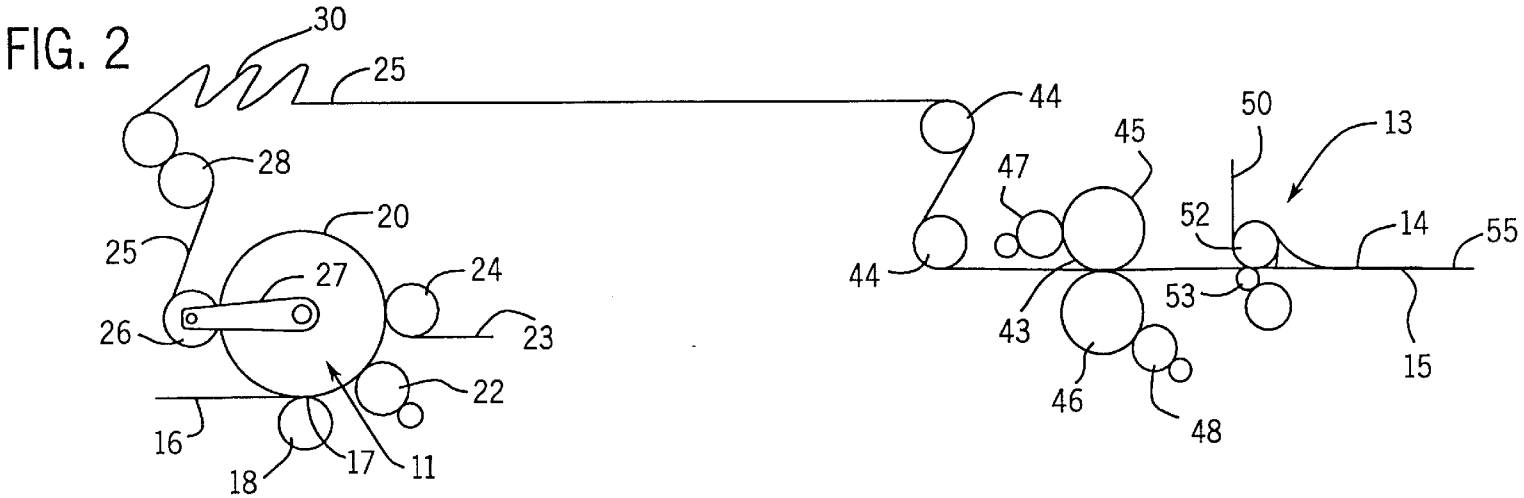
FIG. 2 is a schematic side elevation view of the corrugator of FIG. 1 as operated to produce a single wall corrugated web.

Referring now to FIG. 2, the corrugating apparatus of the present invention is shown in a mode of operation to produce conventional single wall corrugated web utilizing the first single facer 11. In this mode, the second single facer 12 (not shown) is inoperative and the first single face web 25 is directed from the bridge storage 30 directly to the fluted idler roll pair 44 and into the glue applicator 43. Single face web 25, when running horizontally into the glue station 43, is oriented with the corrugated medium web 16 on top to present upper flute tips 21 to upper glue applicator roll 45 which has glue applied to it. Lower glue applicator roll 46 is operated without glue as a conventional rider roll to press the flute tips of the single face web 25 against the glued upper applicator roll 45 with sufficient pressure to facilitate glue transfer to the flute tips 21. In the double backer 13 the freshly glued single wall corrugated web is cured primarily by operating the upper heating unit 14 to apply heat most directly to the freshly glued flute tips 21 to cure the bond between the top liner 50 and the single face web 25. The lower heating section 15 is run at a low heating level or even at ambient temperature.

Figure 3:
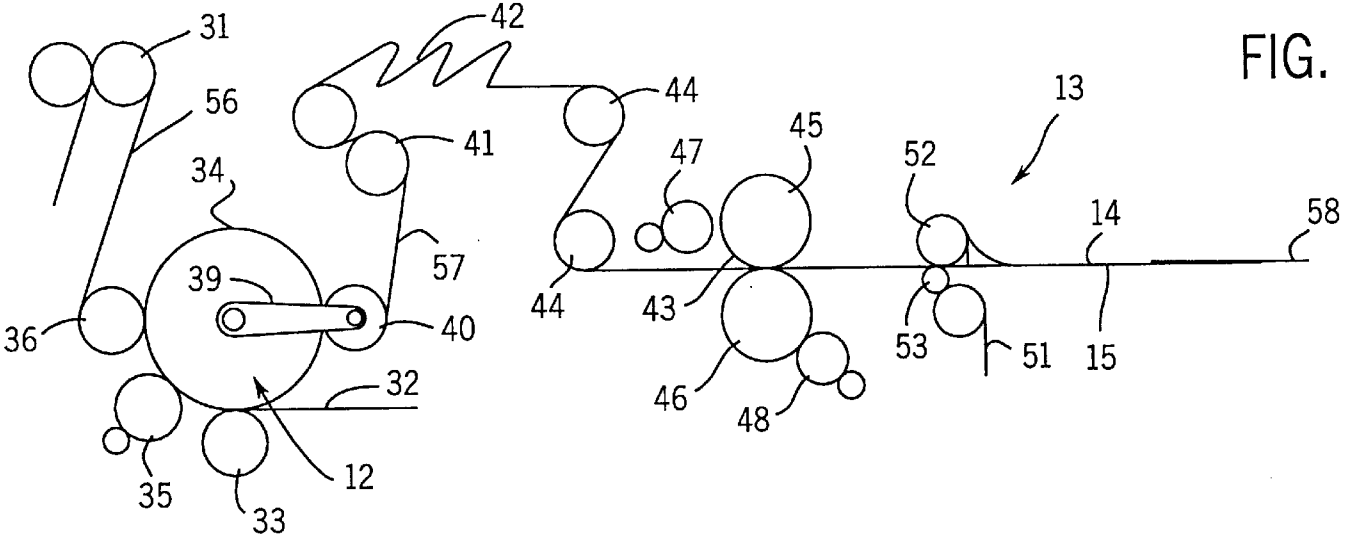
FIG. 3 is a schematic side elevation view of the corrugator shown in FIG. 1 in an alternate mode of operation for the production of a single wall corrugated web.

FIG. 3 shows a mode of operation of the corrugator 10 similar to FIG. 2 for the production of single wall board, but utilizing the second single facer 12 in lieu of the first single facer. A top liner 56 is introduced into the second single facer 12 around the capstan roll 31 and is joined to the glued corrugated medium web 32 on the upper bonding roll 34 to create a single face web 57 oriented oppositely from the single face web produced in the first single facer, this single face web 57 having its fluted medium on the lower face of the liner 56. This may require the use of a non-fluted vacuum pull roll 41 and a non-fluted generator roll 36, both of which engage the liner web 56. Such rolls could be changed from the fluted rolls used in the FIG. 1 mode of operation by utilizing a turret changer or other suitable quick roll change means.

In the glue applicator 43, glue is applied to lower glue applicator roll 46. Upper glue applicator roll 45 is operated without any glue and in a manner opposite to glue station operation for the FIG. 2 embodiment. Upper applicator roll 45 is operated as a conventional rider roll to press the lower flute tips of the single face web 57 against the lower glue applicator roll 46. A lower liner 51 is introduced to the glued single face web 57 and the resultant single wall web 58 is introduced into the double backer 13. The lower heating unit is heated to a temperature sufficient to cure the bond between the single face web 57 and the bottom liner 51, while the upper heating unit 14 is controlled to provide a low level of heat or no heat at all, in the latter mode acting simply as a weight system to hold the component webs together and enhance heat transfer from the lower heating unit 15.

Conventional double wall corrugated web may be run on the corrugating system 10 in a manner nearly identical to the synchronized flute double wall process shown and described with respect to FIG. 1. However, the generator/timing roll 36 does not have to be operated to provide flute-to-flute synchronization between the two corrugated media 16 and 32. The resultant intermediate single face web 38, having non-synchronized flutes, is conveyed to the glue applicator 43 and formed and cured in the double backer 13 to provide double wall web in the same manner previously described. Of course, the flute types as between the first and second single facers may be changed as desired to provide conventional double wall board of any varying flute patterns.

Figure 5:
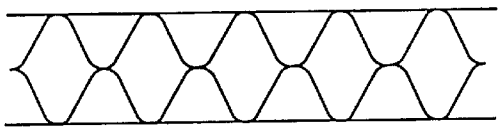
FIG. 5 PRIOR ART
FIG. 5 is an enlarged side elevation view of a section of double wall corrugated web formed in accordance with a prior art apparatus and method.

Referring also to FIGS. 4 and 5, the corrugator 10 of the present invention permits the production of double wall corrugated board similar to the prior art board of FIG. 5, except that the FIG. 4 double wall of the present invention includes the intermediate liner web 23 between the glued flute tips 21 and 37, which intermediate liner is absent in the prior art construction of FIG. 5. The use of the center liner web 23 adds a significant amount of fiber to the double wall board which might seem to be an unnecessary disadvantage over the prior art FIG. 5 board. However, the use of single facers 11 and 12 of the preferred construction, providing lower pressure bonding on a large diameter bonding roll (20 and 34), permits the production of an intermediate single face web 38 with such well-formed flutes that it is possible to reduce the fiber content in the medium webs 16 and 32 in an amount equal to a lightweight intermediate liner 23. The result is believed to be an increased strength-to-weight ratio. The use of an intermediate center liner 23 also makes precise timing and synchronization of the flute tips less critical to the final strength of the board than in the prior art FIG. 5 web. Finally, the corrugator 10 of the present invention, utilizing the preferred component parts as described, is capable of running timed flute double wall board at speeds in excess of 1300 fpm (6.6 meters per second). Because the glue lines on the flute tips 21 and 37 are in contact with their respective outer liners 50 and 51 that are indirect contact with the upper and lower heating units 14 and 15, heat transfer and adhesive curing are greatly enhanced. As a result, a synchronized flute double wall corrugated web 54 may be run as fast as a single wall board 55 or 58.

A fundamental advantage of the synchronized flute double wall board 54 of FIG. 4 over a conventional synchronized flute double wall of FIG. 5 is the improvement in flexural stiffness and flat crush strength for equivalent combined board basis weight. In addition, special flute profiles may be developed to take advantage of the process of the present invention to optimize strength to fiber weight ratios of the resultant corrugated paperboard.

We claim:

1. An apparatus for making corrugated web comprising:

a first single facer for producing a first corrugated medium web and adhesively joining said first medium web to one face of an intermediate liner web to provide a first single face web;

a second single facer for producing a second corrugated medium web and adhesively joining said second medium web to the other face of said intermediate liner web to provide an intermediate single face web having said first and second corrugated medium webs joined by inner flute tips to the respective opposite faces of said intermediate liner web and having exposed flute tips on both sides of said liner web;

each of said first and second single facers comprises a corrugating nip defined in part by a large diameter heated fluted corrugating roll around a substantial portion of the circumference of which the respective adhesively joined medium and liner webs are wrapped to provide a selected level of adhesive bond strength;

a glue applicator for applying glue to the exposed flute tips on both sides of said intermediate single face web; and, a double backer for adhesively joining first and second outer liner webs to the exposed glued flute tips of the respective first and second medium webs of said intermediate single face web to provide a corrugated double wall web.

2. The apparatus as set forth in claim 1 and further comprising:

a synchronization device for aligning the inner flute tips of the first and second corrugated medium webs such that said flute tips joined to the opposite faces of said intermediate liner web are directly aligned.

3. The apparatus as set forth in claim 2 wherein said first and second single facers include fluted corrugating roll providing flutes of identical pitch length in each of said corrugated medium webs, and wherein said synchronization device comprises a fluted timing roll in flute-to-flute register with said fluted corrugating roll of the second single facer for carrying said first single face web into joining contact with said second corrugated medium web on the fluted corrugating roll of the second single facer.

4. An apparatus for making corrugated web comprising:

a first single facer for producing a first corrugated medium web and adhesively joining said first medium web to one face of an intermediate liner web to provide a first single face web;

a second single facer for producing a second corrugated medium web and adhesively joining said second medium web to the other face of said intermediate liner web to provide an intermediate single face web having said first and second corrugated medium webs joined by inner flute tips to the respective opposite faces of said intermediate liner web and having exposed flute tips on both sides of said liner web;

said first and second single facers having fluted corrugating rolls;

said first single facer corrugating roll having a flute pitch length slightly shorter than the flute pitch length of the second single facer corrugating roll;

a synchronization device for aligning the inner flute tips of the first and second corrugated medium webs such that said flute tips joined to the opposite faces of said intermediate liner web are directly aligned, said synchronization device including a tensioning roll for carrying said initial single face web into joining contact with said second corrugated medium web on the fluted corrugating roll of the second single facer and for applying a tension to said intermediate liner web sufficient to stretch the same by the amount of the difference in flute pitch lengths between said first and second corrugating rolls;

a glue applicator for applying glue to the exposed flute tips on both sides of said intermediate single face web; and, a double backer for adhesively joining first and second outer liner webs to the exposed glued flute tips of the respective first and second medium webs of said intermediate single face web to provide a corrugated double wall web.

5. The apparatus as set forth in claim 4 wherein the flute pitch length of the first corrugating roll is up to about 0.4 percent shorter than the flute pitch length of the second corrugating roll.

6. The apparatus as set forth in claim 1 wherein said double backer comprises upper and lower heating devices providing direct contact heating to said first and second outer liner webs.

7. The apparatus as set forth in claim 1 wherein said glue applicator comprises:

first and second glue rolls positioned to apply glue to the exposed flute tips of the respective first and second corrugated medium webs immediately prior to entry of the intermediate single face web into the double backer such that the freshly glued exposed flute tips are contacted only by the respective first and second outer liner webs.

8. The apparatus as set forth in claim 7 wherein said upper and lower glue rolls have their axes of rotation substantially aligned in a common vertical plane to apply glue to the exposed flute tips of said respective first and second medium webs simultaneously.

9. The apparatus as set forth in claim 7 wherein said upper and lower glue rolls are spaced in the direction of web movement to apply glue to the exposed flute tips of said respective first and second medium webs sequentially, said glue rolls positioned to cause the intermediate single face web to be wrapped on said rolls in a serpentine path to provide web tension sufficient to transfer glue to said exposed flute tips.

10. The apparatus as set forth in claim 9 wherein the position of the rolls relative to one another is adjustable to vary the amount of web wrap thereon.

11. A method for making a double wall corrugated web comprising the steps of:

(a) in a first single facer, providing a first corrugating nip defined in part by a first large diameter heated fluted corrugating roll and forming a first corrugated medium web and adhesively joining said first medium web to one face of an intermediate liner web to provide an initial single face web;

(b) wrapping the initial single face web around a substantial portion of the circumference of said first corrugating roll to provide a selected level of adhesive bond strength;

(c) in a second single facer, providing a second corrugating nip defined in part by a second large diameter heated fluted corrugating roll and forming a second corrugated medium web and adhesively joining said second medium web to the other face of the intermediate liner web to provide an intermediate single face web having said first and second corrugated medium webs joined by inner flute tips to the respective opposite faces of said intermediate liner web and having exposed flute tips on both sides of said intermediate liner web;

(d) wrapping the intermediate single face web around a substantial portion of the circumference of said second corrugating roll to provide a selected level of adhesive bond strength;

(e) in a glue applicator, applying glue to the expose flute tips on both sides of said intermediate single face web; and, (f) in a double backer, adhesively joining first and second outer liner webs to the exposed glued flute tips of the respective first and second medium webs of said intermediate single face web to provide said double wall corrugated web.

12. The method as set forth in claim 11 including the step of synchronizing the inner flute tips of the first and second corrugated medium webs such that said flute tips joined to the opposite faces of said intermediate liner web are directly aligned.

13. An apparatus for making a double wall corrugated paperboard web comprising:

a first single facer having a fluted bonding roll forming a first corrugating nip and a heated bonding surface for producing a first corrugated medium web and adhesively joining said first medium web to one face of an intermediate liner web to provide a first single face web having a desired level of adhesive green bond strength;

a second single facer having a fluted bonding roll forming a second corrugating nip and a heated bonding surface for producing a second corrugated medium web and joining said second medium web to the other face of said intermediate liner web to provide an intermediate single face web having said first and second corrugated medium webs joined by inner flute tips to the respective opposite faces of said intermediate liner web in a manner leaving exposed flute tips on both sides of said liner web, said intermediate liner web having a desired level of adhesive green bond strength;

means for applying glue to said exposed flute tips on both sides; and, means for joining first and second outer liner webs to the respective first and second medium webs of said intermediate single face web to provide said corrugated double wall web.

14. The apparatus as set forth in claim 13 and further comprising:

synchronization means for aligning the inner flute tips of the first and second corrugated medium webs such that said flute tips joined to the opposite faces of said intermediate liner web are directly aligned.

* * * * *